US005208569A

United States Patent [19]

Michelangelo et al.

[11] Patent Number: 5,208,569

[45] Date of Patent: May 4, 1993

[54] SIMPLIFIED FLANGELESS UNISEX WAVEGUIDE COUPLER ASSEMBLY

[75] Inventors: Dimartino Michelangelo, La Mesa; Charles P. Moeller, Del Mar, both of Calif.

[73] Assignee: The United States of America as represented by the United States Department of Energy, Washington, D.C.

[21] Appl. No.: 893,154

[22] Filed: Jun. 3, 1992

[51] Int. Cl.[5] ..... H01P 1/06

[52] U.S. Cl. ..... 333/257; 285/321; 285/373; 403/165; 403/302; 439/210

[58] Field of Search ..... 333/254–257; 403/164, 165, 301, 302, 310, 312; 439/210; 285/321, 373, 415, 414, 419

[56] References Cited

U.S. PATENT DOCUMENTS

| | | | |
|---|---|---|---|
| 2,521,818 | 9/1950 | Aron et al. . | |
| 3,076,159 | 1/1963 | Vaughan et al. | 333/255 |
| 3,390,901 | 7/1968 | Bibb | 333/255 |
| 3,712,644 | 1/1973 | Hara et al. | 285/39 |
| 3,966,234 | 6/1976 | Sundholm | 285/415 X |
| 4,533,887 | 8/1985 | Morz et al. | 333/256 |
| 4,675,633 | 6/1987 | Young | 333/257 |
| 4,677,400 | 6/1987 | Griffith et al. | 333/159 |
| 4,879,534 | 11/1989 | Spinner | 333/257 |

*Primary Examiner*—Paul Gensler

*Attorney, Agent, or Firm*—Miguel A. Valdes; Roger S. Gaither; William R. Moser

[57] ABSTRACT

A unisex coupler assembly is disclosed capable of providing a leak tight coupling for waveguides with axial alignment of the waveguides and rotational capability. The sealing means of the coupler assembly are not exposed to RF energy, and the coupler assembly does not require the provision of external flanges on the waveguides. In a preferred embodiment, O ring seals are not used and the coupler assembly is, therefore, bakeable at a temperature up to about 150° C. The coupler assembly comprises a split collar which clamps around the waveguides and a second collar which fastens to the split collar. The split collar contains an inner annular groove. Each of the waveguides is provided with an external annular groove which receives a retaining ring. The split collar is clamped around one of the waveguides with the inner annular groove of the split collar engaging the retaining ring carried in the external annular groove in the waveguide. The second collar is then slipped over the second waveguide behind the annular groove and retaining ring therein and the second collar is coaxially secured by fastening means to the split collar to draw the respective waveguides together by coaxial force exerted by the second collar against the retaining ring on the second waveguide. A sealing ring is placed against an external sealing surface at a reduced external diameter end formed on one waveguide to sealingly engage a corresponding sealing surface on the other waveguide as the waveguides are urged toward each other.

10 Claims, 2 Drawing Sheets

SIMPLIFIED FLANGELESS UNISEX WAVEGUIDE COUPLER ASSEMBLY

BACKGROUND OF THE INVENTION

The invention described herein arose in the course of, or under, Contract No. DE-AC03-89ER51114 between the United States Department of Energy and General Atomics.

This invention relates to a waveguide coupler assembly. More particularly, this invention relates to a unisex waveguide coupler assembly which allows rotation of the respective waveguides with respect to one another and to the coupler assembly, which requires no external flanges on the waveguides, and which maintains the waveguides in leak tight alignment with one another.

The joining of sections of cylindrical waveguides of a transmission line together can result in problems if the connection is not leak tight and does not accurately align the joined together wave guides. Furthermore, it is desirable to join the waveguide sections together in a manner which permits axial rotation of one waveguide relative to the other.

Various prior art coupler designs have been proposed to address one or more of these issues. Aron et al. U.S. Pat. No. 2,521,818 discloses a rotatable wave guide coupling wherein two respective wave guides are received in firmly fitting relation in apertures in end sections of a series of centrally apertured sections within the coupler. The sections within the coupler are designed to be rotatable with respect to one another.

Hara et al. U.S. Pat. No. 3,712,644 teaches a connector for waveguides wherein packing material is disposed between the waveguides and an external connector sleeve, and push rings are threaded onto the connector to force the packing material into sealing relationship between the outer surface of the waveguides and the inner surface of the connector.

Morz et al. U.S. Pat. No. 4,533,887 shows a waveguide coupling wherein the coupling members are coaxially rotatable with respect to each other; while Young U.S. Pat. No. 4,675,633 describes an expansion joint received within two adjacent waveguides to permit longitudinal movement of the waveguides while maintaining axial alignment; and Spinner U.S. Pat. No. 4,879,534 discloses two waveguides coupled together in a manner which permits rotation and tilting of the waveguides relative to one another using external flanges which telescope together and contain a seal ring in one of the flanges.

It would, however, be desirable to provide a coupler assembly for waveguides capable of providing a leak tight coupling with axial alignment and rotational capability, without the need for providing external flanges on the waveguides, yet be capable of easy assembly in the field, with the sealing means not exposed to RF energy, and with the coupler assembly capable of connecting to either waveguide at either end of the coupler assembly, i.e., having unisex ends or mating means to engage either of waveguides. Preferably, the coupler assembly should be bakeable at temperatures up to about 150° C. by elimination of the use of organic O-ring seals.

SUMMARY OF THE INVENTION

The invention comprises a unisex coupler assembly capable of providing a leak tight coupling for waveguides with axial alignment of the waveguides and rotational capability. The sealing means of the coupler assembly are not exposed to RF energy, and the coupler assembly does not require the provision of external flanges on the waveguides. In a preferred embodiment, 0 ring seals are not used and the coupler assembly is, therefore, bakeable at a temperature up to about 150° C.

The coupler assembly of the invention comprises a split collar which clamps around the waveguides and a second collar which fastens to the split collar. The split collar contains an inner annular groove. Each of the waveguides is provided with an external annular groove which receives a retaining ring. The split collar is clamped around one of the waveguides with the inner annular groove of the split collar engaging the retaining ring carried in the external annular groove in the waveguide. The second collar is then slipped over the second waveguide behind the annular groove and retaining ring therein and the second collar is coaxially secured by fastening means to the split collar to draw the respective waveguides together by coaxial force exerted by the second collar against the retaining ring on the second waveguide. A sealing ring is placed against an external sealing surface formed at a reduced external diameter end of one waveguide to sealingly engage a corresponding external sealing surface formed at a reduced external diameter end of the other waveguide as the waveguides are urged toward each other by securement of the second collar to the split collar.

DETAILED DESCRIPTION OF THE INVENTION

Figure 1:
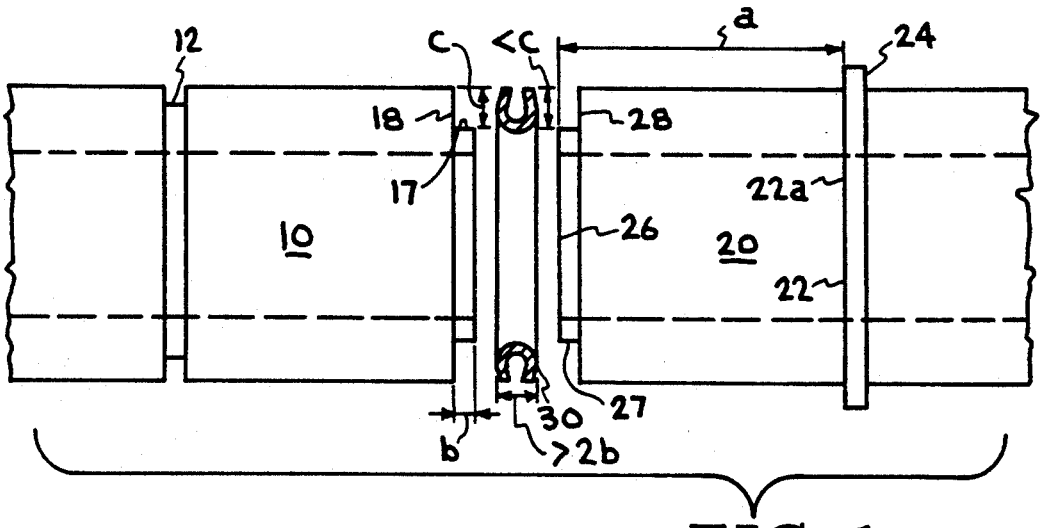
FIG. 1 is an exploded horizontal view of two waveguides to be joined together, showing the seal ring (in cross-section) used to seal the waveguides together.

Referring now in particular to FIG. 1, the respective fragmentary end portions of two waveguides, 10 and 20 to be coupled together are shown. In the illustrated embodiment, waveguides 10 and 20 are cylindrical, i.e., of circular external cross-section. However, it will be understood that the following description is not limited to the coupling together of cylindrically shaped waveguides, provided that the internal bores of the elements comprising the coupler assembly of the invention are of matching cross-section to the exterior cross-section of the waveguides. The use of circular cross-section waveguides in the practice of the invention is, however, preferred to thereby permit the waveguides to be rotated with respect to one another and the coupler assembly.

The illustrated end portions of waveguides 10 and 20 are identical so that either may be used interchangeably at either end of the coupler assembly. Since the illustrated end portions of waveguides 10 and 20 are identical, only the end portion of waveguide 20 will now be described, it being understood that the description is equally applicable to waveguide 10.

Figure 2:
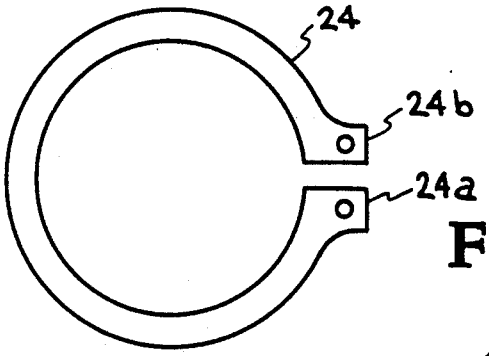
FIG. 2 is a top view of the retaining ring carried by the annular groove in each waveguide.

Waveguide 20 is formed with an external annular groove 22 which receives a retainer ring 24 such as the ring shown in FIG. 2. The side edge of annular groove 22 closest to end 26 of waveguide 20 is spaced a fixed distance "a" from end 26 for a purpose which will be explained below.

End 26 of waveguide 20 is formed with a reduced diameter portion 27 terminating in an annular external sealing surface 28 spaced a distance "b" from end 26 and having a width "c" from the outer diameter of waveguide 20 to receive a compressible seal ring 30 thereagainst.

Compressible seal ring 30 is provided with an ID slightly larger than the reduced OD portion 27 of waveguide 20 at sealing surface 28, i.e., having an ID slightly larger than the regular OD of waveguide 20 minus twice the dimension "c" (the width of sealing surface 28) to permit seal ring 30 to be fitted against sealing surface 28.

Seal ring 30 has a cross-sectional width of slightly larger than twice dimension "b" so that when seal ring 30 is mounted on reduced portion 27 against sealing surface 28, and waveguide 10 is abutted against waveguide 20 and seal ring 30, the respective sealing surfaces 18 and 28 on waveguides 10 and 20 will compress ring 30 to provide a seal therebetween.

Compressible seal ring 30, in the preferred embodiment, may comprise a compressible metal ring such as a Helicoflex Seal ring, available from the Helicoflex Company of Boonton, N.J. However, if it is not necessary that the coupler assembly be capable of being subsequently exposed to elevated temperatures, e.g., a bakeout temperature of 150° C., an O ring seal may be used as seal ring 30 provided that the proper material is selected which will not absorb the particular RF frequencies being propagated in the waveguides and be damaged.

The outer diameter of seal ring 30 is slightly smaller than the regular OD of waveguide 20 so as to not interfere with the subsequent mounting of the split collar portion of the coupler assembly around waveguide 20 as will be explained below. Thus, when the width or depth of sealing surface 28 is "c", the difference between the inner radius and outer radius of seal ring 30 will be less than "c", as shown in FIG. 1.

Figure 3:
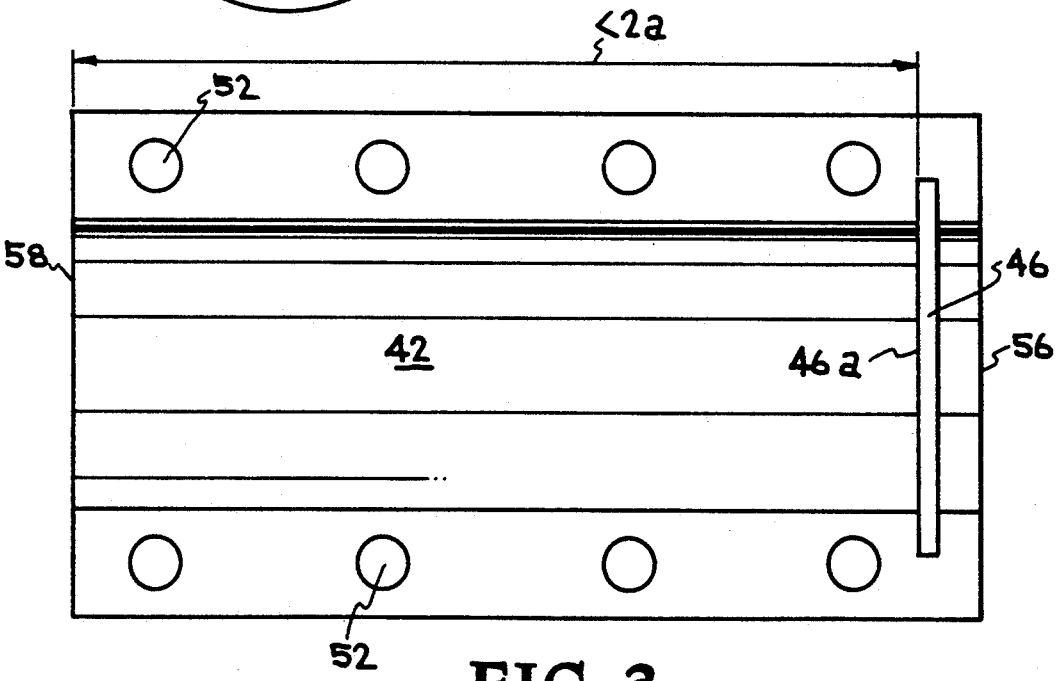
FIG. 3 is a top view of one half of the split collar which is attached to one of the waveguides, looking at the inside of the collar.
Figure 4:
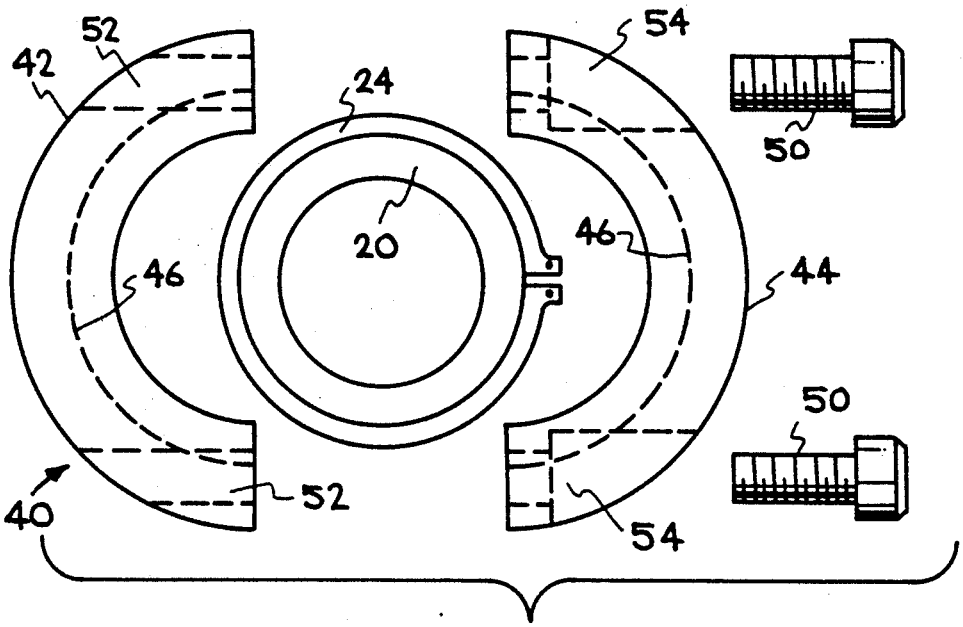
FIG. 4 is an exploded end view showing two of the split collars shown in FIG. 3 about to be clamped around one of the waveguides.

Turning now to FIGS. 3 and 4, a portion of the coupler assembly is shown in FIG. 3, comprising one of two substantially identical split collar halves 42 and 44 which will be clamped around waveguide 20, as shown in FIG. 4, to form split collar 40. For purposes of thermal compatibility, i.e., matching thermal coefficients of expansion and contraction, split collar 40 may be constructed of the same metal used in the fabrication of waveguides 10 and 20, e.g., aluminum.

Split collar halves 42 and 44, when placed together to form split collar 40, define an ID which is approximately equal to or very slightly larger than the OD of waveguide 20 so that when split collar 40 is clamped together, a snug fit will be provided around waveguide 20, thereby preventing any lateral movement which might interfere with the alignment of waveguide 20 with waveguide 10.

Split collar 40 is further provided with an inner annular groove 46, as best seen in FIG. 3, adjacent a near end 56 of collar halves 42 and 44 which will receive the protruding portions of retaining ring 24 carried in annular groove 22 in waveguide 20 to prevent axial movement of waveguide 20 relative to split collar 40, once collar 40 is clamped to waveguide 20. The depth of annular groove 46 is selected to be slightly larger than the largest portion of the periphery of retaining ring 24, i.e., larger than end portions 24*a* and 24*b* of ring 24 so that ring 24 will freely rotate within groove 46, thus allowing waveguide 20, having ring 24 secured thereon, to freely rotate within collar 40 before collar 40 is tightened down using bolts 50, which fit through holes 54 in collar half 44 and are received in threaded bores 52 in split collar half 42.

Annular groove 46 is located within collar 40 adjacent near end 56 of collar 40 with the side edge 46*a* of groove 46 spaced a distance of slightly less than twice "a" from far end 58 of collar 40, as shown in FIG. 3. Since the distance from end 26 of waveguide 20 to near edge 22*a* of annular groove 22 of waveguide 20 is "a", end edge 26 of waveguide 20 will be located beyond the midpoint of collar 40, i.e., closer to far end 58 of collar 40 or a distance less than "a", when waveguide 20 is mounted therein (see FIGS. 3 and 5). This permits waveguide 10 to then be mounted within collar 40 from far end 58 so that its retaining ring 14 (which is located a distance "a" from end 16 of waveguide 10, and is identical to retaining ring 24) will not be encircled by collar 40. That is, retaining ring 14, after waveguide 10 has been inserted into the coupler assembly, will protrude from far end 58 of coupler 40, as best seen in FIG. 6.

Figure 5:
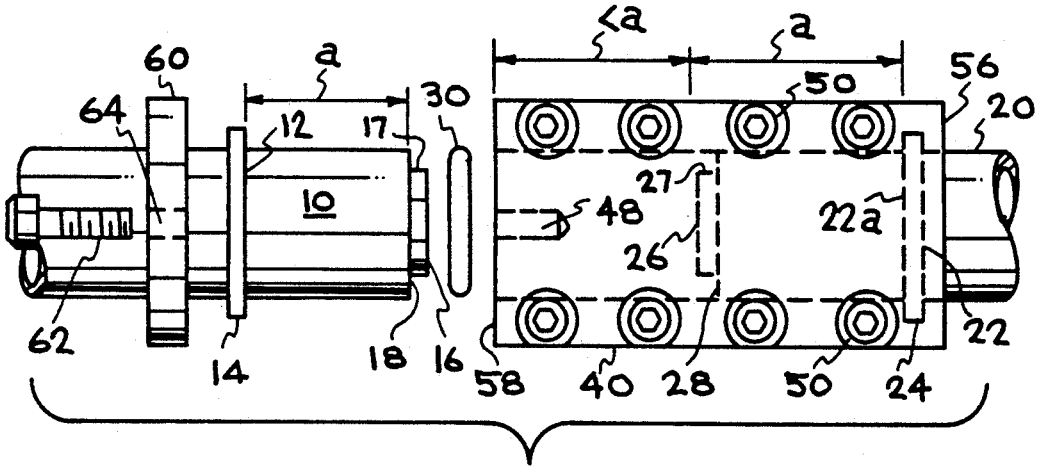
FIG. 5 is an exploded side view showing the first waveguide positioned within the split collar and the second waveguide, with the second collar around it, about to be inserted into the split collar and the second collar clamped to the split collar.
Figure 6:
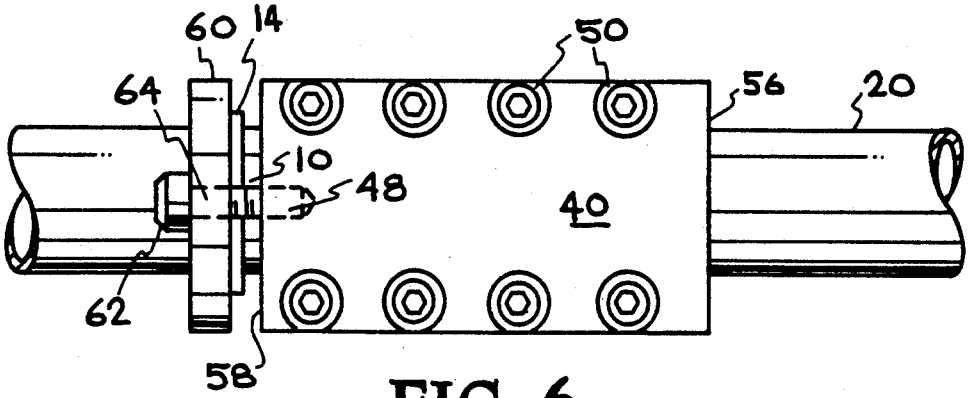
FIG. 6 shows the two waveguides clamped together by the coupler assembly, comprising the split collar and second collar.

As seen in FIGS. 5 and 6, prior to inserting retaining ring 14 into annular groove 12 in waveguide 10, a loose fitting second collar 60, which comprises the other portion of the coupler assembly, is slipped over end 16 of waveguide 10. Retaining ring 14 is then fitted into annular groove 14 of waveguide 10. Second collar 60 may also be formed of the same metal as waveguides 10 and 20 and split collar 40 for purposes of thermal compatibility.

Waveguide 10 is now coupled to waveguide 20 by inserting end 16 of waveguide 10 into far end 58 of split collar 40, which is not completely bolted together at this point, having bolts 50 only hand tightened in threaded bores 54 to secure collar halves 42 and 44 loosely together. If seal ring 30 has not already been placed on reduced portion 27 of waveguide 20 against sealing surface 28 prior to the placing of halves 40*a* and 40*b* of split collar 40 around waveguide 20, seal ring 30 is placed on reduced portion 17 of waveguide 10 of waveguide 10 against sealing surface 18 prior to its insertion into collar 40.

Bolts 62 are then inserted through openings 64 in collar 60 and then into threaded bores 48 in far end 58 of collar 40 to urge respective ends 18 and 28 of waveguides 10 and 20 against opposite sides of seal ring 30 and thus into sealing engagement with one another by action of collar 60 against retaining ring 14 in slot 12 of waveguide 10 as bolts 62 continue to be tightened.

After bolts 62 have been sufficiently tightened to obtain the desired seal between waveguides 10 and 20 via seal ring 30, bolts 50 may be tightened to firmly clamp both halves of split collar 40 securely around waveguide 20, resulting in the final coupled together structure shown in FIG. 6.

Thus, the coupler assembly of the invention provides for a leak tight joining together of two waveguides in a manner wherein the sealing means are not exposed to RF energy; multiple assembly and disassembly of the coupling assembly is possible; the coupler assembly is reversible, permitting either waveguide to be coupled to the other using either end of the coupler assembly (the coupler assembly is unisex); the coupling of the waveguides together can be easily implemented in the field, requiring no special skill to install or remove; the coupler assembly has rotational capability to eliminate bolt clocking problems; axial alignment of the wave guides is maintained; and the coupler assembly is easily and economically fabricated. For thermal compatibility, the main parts of the coupler assembly (the split collar and the second collar) may be made of the same material as the waveguides; and if a metal seal ring is used, the entire assembly may be baked at elevated temperatures due to the total absence of non-metallic parts.

While a specific embodiment of the coupler assembly of the invention has been illustrated and described for carrying out the coupling together of waveguides in accordance with this invention, modifications and changes of the apparatus, parameters, materials, etc. will become apparent to those skilled in the art, and it is intended to cover in the appended claims all such modifications and changes which come within the scope of the invention.

What is claimed is:

1. A unisex coupler assembly for coupling together first and second waveguides of matching external cross-section which comprises:

a) a split collar comprising two half collars, said split collar, when assembled, defining an interior bore matching the external cross-section of said first and second waveguides, and having an annular groove in said interior bore adjacent a near end of said split collar;

b) an external annular groove in each of said first and second waveguides spaced the same distance from an end of said respective waveguides;

c) a retaining ring in said annular groove in each of said first and second waveguides, said retaining ring in said first waveguide being receivable in said annular groove in said split collar when- said first waveguide is inserted into said split collar to protrude from said near end thereof;

d) means for fastening said split collar together around at least said first waveguide with said retaining ring on said first waveguide in said annular groove in said split collar;

e) a second collar having an interior cross-section matching the external cross-section of said waveguides and carried on said second waveguide at a point spaced from said end of said second waveguide, with said annular groove and retaining ring on said second waveguide spaced between said second collar and said end; and f) means for fastening said second collar to said split ring collar and to urge said second collar against said retaining ring on said second waveguide when said end of said second waveguide is inserted into a far end of said split collar to thereby axially urge said second waveguide into sealing engagement with said first waveguide in said split collar.

2. The coupler assembly of claim 1 wherein each of said waveguides is further provided with an external sealing surface on said end thereof facing the other waveguide in said coupler assembly and a seal ring is mounted against said sealing surface to thereby seal said waveguides together.

3. The coupler assembly of claim 2 wherein said seal ring has a cross-section width slighter larger than twice the distance from said sealing surface to the end of said waveguide so that said respective sealing surfaces of said first and second waveguides will engage opposite sides of-said seal ring to provide said seal therebetween when said second collar is fastened to said split collar.

4. The coupler assembly of claim 3 wherein said seal ring is an O-ring.

5. The coupler assembly of claim 3 wherein said seal ring is a metal seal ring whereby said coupler assembly is capable of being subsequently baked at an elevated temperature.

6. The coupler assembly of claim 3 wherein the outer cross-section of said seal ring is smaller than the outer cross-section of said waveguides and said inner bore of said split collar whereby said seal ring will not interfere with rotation of said waveguides in said inner bore of said coupler assembly.

7. The coupler assembly of claim 6 wherein the distance from the end of each of said wave guides to said retaining ring is greater than half the distance from said annular groove in said split collar to said far end of said split collar, whereby when said first waveguide is placed in said split collar, to protrude from said near end, with said retaining ring on said first waveguide in said annular groove in said split collar, said retaining ring on said second waveguide will protrude from said far end of said split collar, when said second waveguide is inserted into said split collar to abut said first waveguide.

8. The coupler assembly of claim 3 wherein said first and second waveguides, said split collar, and said second collar are constructed of the same metal to provide thermal compatibility therebetween.

9. The coupler assembly of claim 3 wherein the outer cross-section of said first and second waveguides is circular and the inner bore of said split collar is also circular in cross-section and of matching diameter to the outer diameter of said circular waveguides.

10. A unisex coupler assembly for coupling together two waveguides of identical cylindrical external cross-sections which comprises:

a) first and second waveguides, each having a first end thereon of reduced external diameter;

b) an external annular groove in each of said waveguides spaced a distance "a" from said first end of said waveguide;

c) a split collar comprising two half collars, said split collar, when assembled, defining a central circular bore having a diameter matching the external diameters of said cylindrical waveguides and having an annular groove in said interior bore adjacent a near end of said split collar and spaced a distance less than twice said distance "a" from a far end of said central bore in said split collar;

d) a retaining ring in said annular groove in each of said waveguides, said retaining ring having a width slightly less than the width of said annular groove in said interior bore of said split collar and protruding from the surface of said waveguide a distance less than the depth of said annular groove interior bore of said split collar to permit said retaining ring to fit into said annular groove in said interior bore of said split collar when said split collar is assembled around said waveguide;

e) means for fastening said split collar together around said first waveguide, with said first waveguide protruding from said near end of said central bore in said split collar;

f) a second collar having a central bore slightly larger than the diameter of said cylindrical waveguides and assembled on said second waveguide at a point from said first end of said second waveguide greater than the distance from said first end of said second waveguide to said annular groove and retaining ring on said second waveguide;

g) an external sealing surface formed adjacent said first end of said first and second waveguides at the terminated of said reduced external diameter portion of said first and second waveguides;

h) a seal ring carried on one of said reduced external diameter portions of said waveguides; and i) means for fastening said second collar to said split ring collar which will urge said second collar against said retaining ring on said second waveguide to urge said second waveguide into said far end of said central bore of said split collar to sealingly engage said seal ring against said sealing surface of said first waveguide in said split ring collar.

* * * * *